US010495353B2

(12) United States Patent
Polihronov et al.

(10) Patent No.: US 10,495,353 B2
(45) Date of Patent: Dec. 3, 2019

(54) MECHANISM FOR ENHANCED ENERGY EXTRACTION AND COOLING OF PRESSURIZED GAS AT LOW FLOW RATES

(71) Applicant: The University of Western Ontario, London (CA)

(72) Inventors: Jeliazko Polihronov, London (CA); Anthony Straatman, Thorndale (CA)

( * ) Notice: Subject to any disclaimer, the term of this patent is extended or adjusted under 35 U.S.C. 154(b) by 908 days.

(21) Appl. No.: 14/839,246

(22) Filed: Aug. 28, 2015

(65) Prior Publication Data

US 2015/0377524 A1 Dec. 31, 2015

Related U.S. Application Data

(63) Continuation-in-part of application No. 14/404,606, filed as application No. PCT/CA2013/050411 on May 28, 2013.

(60) Provisional application No. 61/652,275, filed on May 28, 2012.

(51) Int. Cl.
*F25B 9/04* (2006.01)

(52) U.S. Cl.
CPC ..... *F25B 9/04* (2013.01)

(58) Field of Classification Search
CPC ... F01D 1/32; F01D 1/34; F01D 5/043; F01D 5/046; F01D 5/084; F01D 5/087; F25B 9/04
See application file for complete search history.

(56) References Cited

U.S. PATENT DOCUMENTS

| | | | | |
|---|---|---|---|---|
| 1,061,206 | A | 5/1913 | Tesla | |
| 2,768,808 | A | 10/1956 | Worre | |
| 2002/0037216 | A1* | 3/2002 | Oya | F01D 5/08 415/114 |
| 2004/0129409 | A1* | 7/2004 | Mok | F04D 29/582 165/80.3 |
| 2005/0169743 | A1 | 8/2005 | Hicks | |

(Continued)

FOREIGN PATENT DOCUMENTS

| | | |
|---|---|---|
| JP | 2002174166 A | 6/2002 |
| JP | 2003269189 A | 9/2003 |

OTHER PUBLICATIONS

G. J. Ranque, "Experiments on expansion in a vortex with simultaneous exhaust of hot and cold air", J. Phys. Radium, vol. 4, p. 112S, 1933.

(Continued)

*Primary Examiner* — Carlos A Rivera
*Assistant Examiner* — Cameron A Corday
(74) *Attorney, Agent, or Firm* — Brion Raffoul

(57) ABSTRACT

Systems, methods, and devices relating to a mechanism which can be used in gas cooling devices, pneumatic motors, turbines and other pressurized gas devices. A rotatable rotor is provided along with a number of hollow conduits that radially radiate from an exit port at the center of the rotor. The pressurized gas is injected into the mechanism at the inlet port(s). The gas enters the conduits and travels from the inlet port(s) to the exit port(s). In doing so, the gas causes the rotor to rotate about its central axis while the gas cools. This results in a colder gas at the exit port(s) than at the inlet port(s) due to an enhanced extraction of work, while maintaining a very low flow rate at the cold outlet.

16 Claims, 8 Drawing Sheets

(56) References Cited

U.S. PATENT DOCUMENTS

| | | | | |
|---|---|---|---|---|
| 2011/0027069 | A1* | 2/2011 | Couto | F03B 1/02 415/90 |
| 2011/0255979 | A1 | 10/2011 | Matsushita | |
| 2015/0338143 | A1* | 11/2015 | Sakai | F04B 17/03 417/415 |

OTHER PUBLICATIONS

Y. Xue, M. Arjomandi and R. Kelso, "A critical review of temperature separation in a vortex tube", Exper. Therm. Fluid Sci., vol. 34, p. 1367, 2010.
E. A. Baskharone, "Principles of Turbomachinery in air-breathing engines", Cambridge University Press, Jul. 31, 2006.
M. G. Rose, "From Rothalpy to Losses", Lecture Notes, Swiss Federal Institute of Technology LSM Zurich 2002.
R. Resnick and D. Halliday, "Physics I", p. 307, Wiley, 1966.
R. T. Balmer, "Pressure-driven Ranque-Hilsch Temperature Separation in Liquids", J. Fluid Engn., vol. 110, p. 161, 1988.
R.A. Van den Braembussche. "Micro Gas Turbines—A Short Survey of Design Problems", NATO, RTO-EN-AVT-131, (2005).
M. O. Hamdan, A. Alawar, E. Elnajjar and W. Siddique, "Feasibility of Vortex Tube Air-Conditioning System", Proc. ASME, AJTEC2011, (2011).
International Search Report of PCT/CA2013/050411.

* cited by examiner

MECHANISM FOR ENHANCED ENERGY EXTRACTION AND COOLING OF PRESSURIZED GAS AT LOW FLOW RATES

RELATED APPLICATIONS

This application is a Continuation-in-Part of U.S. Non Provisional application Ser. No. 14/404,606 filed Nov. 28, 2014, which claims the benefit of U.S. Provisional Patent Application No. 61/652,275 filed May 28, 2012.

TECHNICAL FIELD

The present invention relates to methods and devices relating to the vortex tube effect and its application in a mechanism that can be used in various practical applications.

BACKGROUND OF THE INVENTION

Various physical phenomena have been analyzed and their practical applications have been found over the years. This document revisits the concept of angular momentum conservation and the corresponding propulsion imparted to a reference frame by an ejected fluid. The focus is on constrained flows within moving frames, where flow confinement results in a well-defined physical problem. The thermophysics of the phenomena are examined with a particular goal in mind—namely, to predict the fluid temperature as observed in different frames of reference, to predict the angular propulsion imparted to the rotating reference frame, as well as describe the underlying physics leading to such observations. Attention is devoted to the applicability of the presented physical model to rotational flows, which exhibit radial temperature separation. A most relevant example is the vortex tube effect, discovered in 1933 by the French physicist Georges J. Ranque. The effect has now been studied for more than 80 years, yet while a number of models have been proposed, they remain a subject of debate. The fundamental reason for this is the complexity of vortex tube flow obscuring the underlying physics, which in its turn obfuscates any concise understanding of the effect. Notwithstanding, interest in the vortex tube phenomena remains high, as demonstrated by a present day literature search in the Google Scholar database resulting in 4240 references to published documents discussing the topic of vortex tube airflow.

SUMMARY OF INVENTION

The present invention provides systems, methods, and devices relating to a mechanism which can be used in gas cooling devices, pneumatic motors, turbines and other pressurized gas devices. A rotatable rotor is provided along with a number of hollow conduits that radially radiate from an exit port at or near the center of the rotor, which allows maximum extraction of work. The pressurized gas is provided to the mechanism at the inlet(s) of the rotor. The gas then enters the conduits and travels from the inlet(s) of the rotor to the exit port. In doing so, the gas causes the rotor to rotate about its central axis while the gas cools. This results in a colder gas at the exit port than at the outer perimeter of the rotor. The particular geometry of the rotor permits maximum extraction of work at low flow rates.

In one aspect, the present invention provides a mechanism comprising:

a rotatable rotor having an axis of rotation;

an exit port;

an inlet port, said inlet port being for receiving pressurized gas;

a hollow conduit, said hollow conduit directly connecting said inlet port to said exit port;

a conversion section for converting rotational energy of said rotor to thereby achieve a cooling of said pressurized gas;

a refrigeration section for cooling said pressurized gas;

wherein a radial distance between said axis of rotation and said exit port is less than a radial distance between said axis of rotation and said inlet port;

pressurized gas received at said inlet port passes from a periphery of said rotor to said exit port through said conduit to thereby cause said rotor to rotate about said axis of rotation;

after passing through said conduit, said pressurized gas at said exit port is colder than said pressurized gas at said periphery of said rotor;

said conversion section of said mechanism is thermally isolated from said refrigeration section of said mechanism.

In another aspect, the present invention provides a method for enhanced cooling of a gas at low flow rates, the method comprising:

a) pressurizing said gas to produce a pressurized gas;

b) providing a mechanism comprising:

a rotatable rotor having an axis of rotation;

an inlet port at a periphery of said rotor;

an exit port, a radial distance between said exit port and said axis of rotation being less than a radial distance between said inlet port and said axis of rotation;

a hollow conduit directly connecting said inlet port to said exit port;

c) providing said pressurized gas at a periphery of said rotatable rotor to allow said pressurized gas to enter said inlet port;

d) thermally isolating a refrigeration section of said mechanism from a conversion section of said mechanism;

wherein pressurized gas provided at said inlet port passes from the periphery of said rotor to said exit port through said conduit to thereby cause said rotor to rotate about said axis of rotation.

BRIEF DESCRIPTION OF THE DRAWINGS

The embodiments of the present invention will now be described by reference to the following figures, in which identical reference numerals in different figures indicate identical elements and in which.

DETAILED DESCRIPTION

Figure 1:
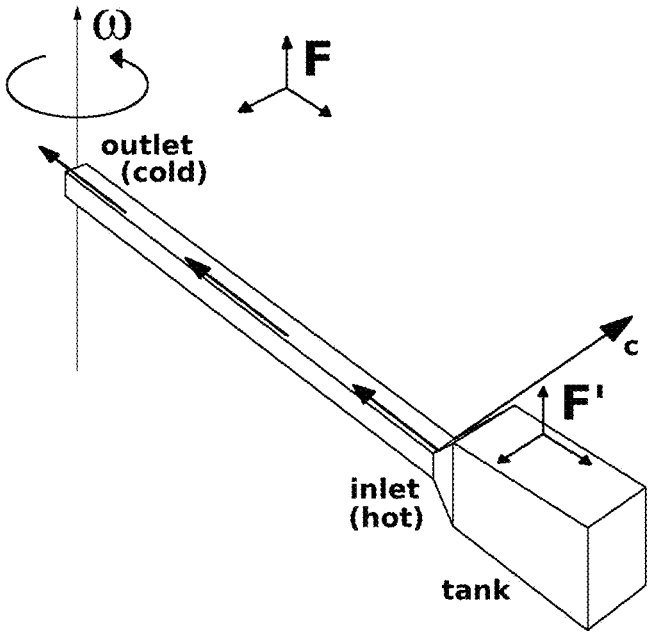
FIG. 1 is a schematic diagram used to explain the principles of the invention.

Referring to FIG. 1, the uniform rotation of a straight adiabatic duct about the vertical symmetry axis of its outlet produces cooling of air at the rotation center of the device. Air is supplied to the duct inlet by a pressurized gas tank at room temperature. In FIG. 1, the tank is mounted to the duct inlet and rotates with the duct. As air moves radially inward, it imparts its kinetic and internal energy as propulsion to the rotating system. This produces a twofold benefit: elimination of the requirement for power to sustain rotation and cooling of air at the exit of the device. Based on these findings it can be concluded that the rotation of this simple device and the accompanying refrigeration of air can be utilized in providing enhanced, instantaneous, on-demand refrigeration of air, and shaft work due to the angular propulsion of the rotating system.

Thus in one aspect the present invention provides a rotational device, comprising:

a) a conduit D with length R and drive means connected to the conduit D to impart an initial rotational velocity (pre-rotation) to said conduit D;

b) an air tank, which provides compressed air to the inlet of duct D c) a cold exit vent positioned at a device centre, wherein pre-rotated air, supplied at the device periphery is run through the device and undergoes a temperature decrease, as this spiral motion of air continues to propel the device, leading to the exhaust of cold air via said central exit vent.

Generally speaking, the systems described herein are directed to method and device that reproduces and controls the vortex tube effect. Multiple embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

For purposes of teaching and not limitation, the illustrated embodiments are directed to the method and device that that reproduces and controls the vortex tube effect.

It should be noted that the analysis of the vortex phenomenon assumes a priori that a rotating flow can be discretized. Also examined is the behavior of the phenomenon's discrete element—a paradigm through which the long-standing physical phenomenon of temperature separation unravels and becomes accessible to analysis. The main reasoning in this work follows along the lines of establishing relative contexts of a stationary and moving observer, positioned in their corresponding reference frames, followed by an examination of relative flow motion and the relevant conservation laws.

In the physics of fluids, the thermodynamic (or static) temperature $T_s$ is that which corresponds to thermal equilibrium and is the same in all frames of reference. The total, or stagnation, temperature is an effective temperature that originates from the total (or stagnation) enthalpy $$h=h_s+v^2/2$$

via division by the isobaric heat capacity $c_p$, and takes the form $$T \equiv T_s + \frac{v^2}{2c_p} \tag{1}$$

where v is the fluid velocity. Because the total temperature contains v, it is, consequently, frame-dependent. In a moving frame F', this temperature becomes $$T_{ref} \equiv T_s + \frac{v'^2}{2c_p} \tag{2}$$

where v' is the flow velocity relative to the frame. In adiabatic duct flow, the conservation of energy demands that the total enthalpy is conserved. Thus, utilizing the connection between total enthalpy and total temperature, energy conservation can also be expressed as $$T \equiv const \tag{3}$$

under adiabatic flow conditions.

Consider the reference frame F', rotating about the z-axis with constant angular velocity ω=const. Energy conservation in rotating fluid flows has the form $$T_s + \frac{v'^2 - (\omega \times r)^2}{2c_p} = const \tag{4}$$

under adiabatic conditions. Let the rotating frame F' be attached to a fluid flow system, comprising a tank of compressible fluid under high pressure and room temperature $T_\infty$, connected to the inlet of an adiabatic duct, as shown in FIG. 1. The compressed fluid is allowed to flow through the duct where it gradually expands, accelerates and exits at the center of the frame. The velocity addition formula for the system is $$v=v'+\omega\times r \tag{5}$$

Expressing v' and substituting it into the energy conservation condition (4) yields $$T_s + \frac{v^2 - 2v\cdot(\omega\times r) + (\omega\times r)^2 - (\omega\times r)^2}{2c_p} = const \tag{6}$$

Reworking this expression to include the total fluid temperature T seen in the stationary frame yields $$T_s + \frac{v\cdot(\omega\times r)}{2c_p} = const \tag{7}$$

Therefore, the observer in the stationary frame F will report a temperature difference $$\Delta T = T(\text{inlet}) - T(\text{outlet}) = \frac{v_{inlet}\cdot(\omega\times r_{inlet})}{c_p} - \frac{v_{outlet}\cdot(\omega\times r_{outlet})}{c_p} \tag{8}$$

between the high-energy peripheral flow and the low-energy flow at the rotation center. Since, in this particular fluid flow system, the duct is straight, $$v' \perp \omega \times r$$

everywhere, and because the flow exits at the rotation center, $r_{outlet}=0$. If we denote the peripheral tip speed of the duct $$\omega \times r_{inlet}$$

as c, then (8) reduces to $$\Delta T = T(\text{inlet}) - T(\text{outlet}) = \frac{c^2}{c_p} \tag{9}$$

Thermodynamics of the flow is interpreted in F and F' as follows:

According to an observer in the moving frame F':

1. Both static and relative total temperatures in the fluid tank are equal to $T_\infty$;
2. The tank fluid expands through the duct and does work to overcome the centrifugal gravitational potential $-(\omega \times r)^2/2$; the exiting fluid has lost internal energy and has gained gravitational potential energy;
3. The fluid accelerates through the duct, due to expansion, and experiences the deflecting action of the Coriolis force;
4. At the outlet, the exiting fluid has a higher velocity than at the duct inlet due to expansion, but has lost internal energy and is $c^2/2c_p$ cooler than $T_\infty$.

According to an observer in the stationary frame F:

1. The total temperature in the pressurized fluid tank is $T=T_\infty+c^2/2c_p$ due to the motion of F';
2. The fluid speed at the duct inlet is equal to c and the temperature is equal to the temperature in the fluid tank $T(\text{inlet})=T_\infty+c^2/2c_p$;
3. High-energy fluid decelerates as it approaches the outlet; that is, while the radial velocity increases, the tangential velocity goes to zero, resulting in a substantial net deceleration;
4. At the outlet, the exiting fluid has low velocity and has also lost internal energy. This conclusion contradicts the intuition of the stationary observer, since a high-energy volume of compressible fluid is expected to exhibit a static temperature rise when brought to rest adiabatically.

It is seen that the energy conservation condition (7) imposes radial dependence in the total temperature known as temperature separation. It is a physical phenomenon, in which rotating fluid flow appears heated at the periphery and cooled at the center of rotation. Therefore, in the case of rotation, cooling of the ejected fluid is due to conservation of angular momentum and the corresponding angular propulsion imparted to the rotating frame. It is this element that leads to a clear understanding of the temperature separation effect in fluids. Since the energy conservation requirement (4) applies under adiabatic conditions, it prohibits heat exchange through the duct walls in the system in FIG. 1. Therefore the cooling of the fluid (9) is a result of adiabatic expansion, during which the fluid does work on its surroundings by propelling the moving reference frame.

Let us now begin to examine the rotating duct system with the goal of determining the propulsion energy that goes into the rotation as a result of an ejection of the gas coming from the tank. For this purpose, consider that the rotating tank and duct assembly is a system with variable mass. This is the main physical context within which the following study will be made.

Let M be the constant composite mass of this system, moving with angular velocity $\omega=c/r$ in a circle with radius r. For generality, consider the position vector R and velocity vector v in the stationary frame of reference F (which reduces to r and c in the system shown in FIG. 1). Consider an external torque (e.g. resistance of the medium) $\tau_{ext}$ be acting on M at time t. At some later moment $t+\Delta t$, the composite system ejects mass $\Delta M$, which moves radially inwards on a radial constraint and thus the angular momenta L are $$L(t)=R\times Mv$$

$$L(t+\Delta t)=R\times(M-\Delta M)(v+\Delta v).$$

The rotational equivalent to the second law of Newton $$R\times M\dot{v}=\tau_{ext}-R\times\dot{M}v,$$

for this constant mass system in F is $\tau_{ext}=\Delta L/\Delta t$, which leads to the equation of rotational motion as $\Delta t\rightarrow 0$ where the mass flux dM/dt is negative, since the mass of the body is decreasing in time. A tacit assumption is that mass dM, even though moving initially with velocity v as part of the composite mass M, reaches zero velocity at the rotation center within a time interval dt.

For rotating systems with finite size, this is still a reasonable assumption, since masses dM, each moving with their own speed within the system, form a continuous radial flow of ejected mass dM/dt.

The expression $$R\times\dot{M}v$$

represents rotational thrust, which is maximum in the stationary frame F, since the velocity of the expelled mass is zero. This expression has dimension of torque; it is to be attributed to the third law of Newton, according to which the rotating system experiences the reaction torque of the radially ejected mass flow dM/dt.

The rotational motion produced always corresponds to maximum thrust when mass is ejected at the center of rotation where its velocity is zero. Let us consider the case v=const, where the external resistance of the environment is precisely counterbalanced by the rotational thrust. In this case, the power delivered to the rotational system by the thrust torque is $$\tau_{ext}\cdot\omega=\dot{M}v^2$$

since $$\tau_{ext}=R\times Mv \text{ and } R\perp v$$

which leads to $$\tau_{ext}\cdot\omega=\tau_{ext}\omega.$$

Then, the thrust energy delivered to the system per expelled mass M is $$E_t=Mv^2.$$

The equations of mechanics are sufficient to describe the concept of the propelled rotational motion. However, one is led to conclude that the most practically important variable mass systems will rely on the properties of gas: gases can form continuous flow and thus produce constant thrust; also, gases are capable of storing energy, which is reflected by their temperature. For these reasons, the thermodynamics of rotating variable mass systems is important, and will be included in this study.

As it was shown in (9) above, the exiting gas experiences a drop in total temperature $\Delta T=c^2/c_p$. It was shown that according to an observer in F, there is a radial gradient of the total temperature over the entire radial extent of the system. The tank at the periphery appears heated (entirely kinetic, not thermodynamic heating), while the exhaust gas at the center is cold. Since the total temperature T is defined through the total (stagnation) enthalpy of the gas, the energy transferred as propulsion to the rotating system is $$E_t = c_p M \Delta T = M v^2,$$

the same expression as the one for thrust energy delivery (with v=c at the duct inlet), calculated above entirely with the equations of mechanics. Thus, energy was invested into the gas in a twofold process:

(i) energy $Mv^2/2$ was invested as internal energy and (ii) kinetic energy $Mv^2/2$ was invested by setting the system in rotational motion with angular velocity ω.

By ejecting itself from the center of mass of the rotating system, gas with mass M spends internal energy $Mv^2/2$ in order to decrease its kinetic energy by $Mv^2/2$, thus imparting rotational thrust energy $Mv^2$ to the system.

Thus, rotary propulsion motion producing maximum thrust is the rotational motion of a system with variable mass, exhausting at its center. The rotational system can also be characterized as an angular propulsion engine (APE) that derives thrust torque due to conservation of angular momentum, i.e. $\tau_{ext}=\Delta L/\Delta t$. The maximum propulsion energy attributed to an APE having peripheral speed v by the ejection of gas at its center is $Mv^2$–a sum of two equal energy portions, one of which is due to the deceleration of the expelled gas and the other to its cooling. The basic rotational system we studied exhibits a gradient of the total temperature over the entire radial extent of the system, as witnessed in the stationary reference frame F. The mechanics of the rotating system has a direct and precise connection to the cooling of gas explained in the thermodynamics argument above, and thus further elucidates the concept of angular propulsion. In addition, the treatment presented herein shows that the thermophysics of the rotating system is derived based on existing laws; no special treatment to the mass, Navier-Stokes or energy transport equations for compressible, rotating flows is implied. On this basis, it is not surprising that commercially available computational fluid dynamics solvers are already capable of predicting the observed cooling effect.

What are the conditions under which no cooling is observed? If the reference frame containing the flow is not moving, no cooling will be observed since the frame is unable to absorb the flow energy. For a duct at rest, where the exiting flow velocity has been chosen to be equal to c, no temperature decrease is observed. Cooling in the stationary frame is produced only when the duct system is moving and able to absorb the energy of the flow as thrust or propulsion. The produced temperature separation ΔT grows with the magnitude of the frame velocity c and is limited by the speed of sound in the surrounding fluid for practical reasons. ΔT is always symmetric with respect to the ambient temperature $T_\infty$ and equal to $c^2/c_p$. When c is nearly equal to the speed of sound at sea level (340 m/s), ΔT=115.2 K. The heating of $c^2/2c_p$=57.6 K is entirely dynamic and due to the motion of the duct periphery with velocity c; the cooling is due to an adiabatic expansion needed to overcome the centrifugal potential barrier and has magnitude of $c^2/2c_p$=57.6 K.

It is also important to note that compressibility of the fluid is vital for storing internal energy, which would later be imparted to the frame upon decompression as well as result in a reduction of static temperature. In the case of incompressible fluids, energy is still transferred to the frame due to angular momentum conservation, however this cannot produce cooling as the fluid is unable to give up internal energy. The same conclusion is found in the work of R. Balmer, where water was used as the working fluid in a vortex tube. Cooling was not achieved in any of the conducted experiments by Balmer and fluid at the periphery was reported to have an elevated temperature. This result is consistent with angular propulsion imparted on the rotating fluid, resulting in high kinetic energies at the periphery consequently leading to heating through friction.

It is also worth noting that the magnitude of ΔT does not depend on the radial size of the rotating system, as long as its peripheral velocity is equal to c in the stationary frame. In addition, centrifugal and Coriolis forces alone cannot alter the total temperature of the flow, since no work is subtracted from the fluid under gravity.

Flow through the rotating duct shown in FIG. 1 was also computed using the commercial computational fluid dynamics (CFD) solver FLUENT to demonstrate that the results of the presented theoretical model are also obtained by discretely solving the differential transport equations for mass, momentum and energy. Simulations were performed with air as an ideal gas using the 3-dimensional, double precision discretization model for compressible flow. The standard version of the k-ε model with wall-functions was used to characterize turbulence effects, and the second-order upwind discretization scheme was used to model advection in the transport equations. Since physical scale is not a factor in the current treatment, the duct was given a length of 15 m and rectangular cross-sectional dimensions 0.3 m×0.4 m with no-slip, adiabatic walls. Smaller or larger ducts will produce the same effect provided the rotational speed is adjusted to develop the same pressure gradient across the duct. In all calculations, the mass flow rate of the air was fixed at 3 kg/s; the highest rotational speed was selected such that the peripheral velocity of the duct c remained subsonic. Energy, momentum and mass conservation were reached in all simulations, with residuals decreasing smoothly to below $10^{-13}$. Table 1 compares the theoretical $\Delta T=\omega^2 r^2/c_p$ (r=15 m) with its corresponding total temperature difference predicted by FLUENT for different rotational speeds.

TABLE 1

ΔT for different rotation rates

| | ω, rad/s | | | | | |
|---|---|---|---|---|---|---|
| | 0 | 2 | 5 | 10 | 15 | 20 |
| ΔT, CFD [K] | 0 | 0.89 | 5.53 | 22.08 | 49.68 | 88.3 |
| ΔT, Eq. (9), [K] | 0 | 0.9 | 5.61 | 22.42 | 50.45 | 89.69 |

The CFD predictions approximate the theoretical result to within 1.5% in all cases. This comparison shows that the numerical values for ΔT given by Equation (9) are also obtained using another well-established method. It should be borne in mind that CFD utilizes discretization and turbulence modeling and as such represents an approximation to the physical phenomena described above.

While the setup in FIG. 1 is not identical to a vortex tube, it demonstrates the essential physical characteristics of the vortex tube flow, namely spiral flow geometry accompanied by radial pressure and temperature behaviour. Therefore, a rotating duct or conduit can be considered a discrete element of the vortex tube flow field. It presents a simplification in the description of vortex tube flow, which allows for a succinct explanation of the vortex tube phenomenon. For the rotating duct, flow is driven from the periphery to the center by a pressure gradient that opposes the centrifugal gravitational field induced by rotation. Energy is imparted by the expanding fluid to propel the rotating frame via the interface between the fluid and the solid (i.e. the duct or conduit wall). In this manner, maximum energy exchange occurs and the maximum possible temperature separation is observed. In the case of a vortex tube, flow is driven from the periphery of the tube to the center by a pressure gradient that opposes the induced gravitational field, but the expanding fluid can only transfer energy to the rotating frame (the fluid itself) via fluid friction, leading to less efficient cooling than that for the confined flow.

One difference between the rotating duct and the vortex tube is the necessity of a hot fluid outlet in the latter. The hot outlet is not required in the rotating duct because the compressed fluid source is rotating with the duct; the only heating that occurs is due to fluid friction opposing the flow towards the duct outlet. In a vortex tube, the fluid enters the tube at the periphery to generate the swirling flow, and to set up the (centrifugal) gravitational field and the pressure gradient. Because of the high flow speeds required to set up the required gravitational field, fluid friction results in significant viscous dissipation at the periphery, which must be removed to achieve any cooling effect at the cold outlet (relative to the inlet). If the hot outlet were closed, the fluid leaving the system would simply absorb all of the viscous heat and leave the system warmer than it entered.

In terms of the magnitude of temperature separation, the control parameters in either case are the rotational speed of the fluid and the radius from the center to the periphery, since this sets up the strength of the centrifugal gravitational field, which dictates the pressure gradient from the periphery to the center. This pressure gradient dictates the maximum temperature drop that can be achieved by expansion of the fluid as it flows towards the cold outlet.

When radial flow of a compressible fluid takes place in a uniformly rotating adiabatic duct, the resulting cooling that is observed at the centre of rotation is due to adiabatic expansion of the fluid as well as conservation of angular momentum, which demands transfer of internal and rotational energy of the moving mass to the rotational energy of the system. Cooling cannot be produced in a stationary duct by gravity, as frame motion is required for an energy transfer to occur. Compressibility is another required factor for cooling since it reflects the ability of the fluid to give away internal energy. Of key importance is that the confined rotating fluid flow system presented in this work exhibits the essential physics of the vortex tube flow, namely radial temperature and pressure gradients as well as velocity fields and flow geometry. It is therefore plausible to consider this simplified flow system as a discrete element of vortex tube flow, which provides a concise understanding of the observed temperature separation phenomenon.

The above can be seen as the theoretical basis for one aspect of the invention. In one implementation, the present invention provides a mechanism which may be used for rotary motors, the cooling of gases, and the efficient conversion of gas pressure into mechanical work, while maintaining a very low flow rate at the cold outlet, namely between 9 and 25 scfm (standard cubic feet per minute; or 255 and 708 slpm) or higher. To the best of our knowledge, this property combination is not achievable with present day turbine technology due to the very small tolerances required in miniature turbines [see R. A. Van den Braembussche. Micro Gas Turbines—A Short Survey of Design Problems", NATO, RTO-EN-AVT-131, (2005).] As a cooler, the coefficient of performance (COP) of this configuration is limited by the theoretical bound of 250% for air, 1111% for R-114, 1500% for R-218 and 2000% for n-Heptane. In comparison, vortex tubes achieve a COP of 3-5% for air [see M. O. Hamdan, A. Alawar, E. Elnajjar and W. Siddique, Feasibility of Vortex Tube Air-Conditioning System", Proc. ASME, AJTEC2011, (2011).]

Figure 2:
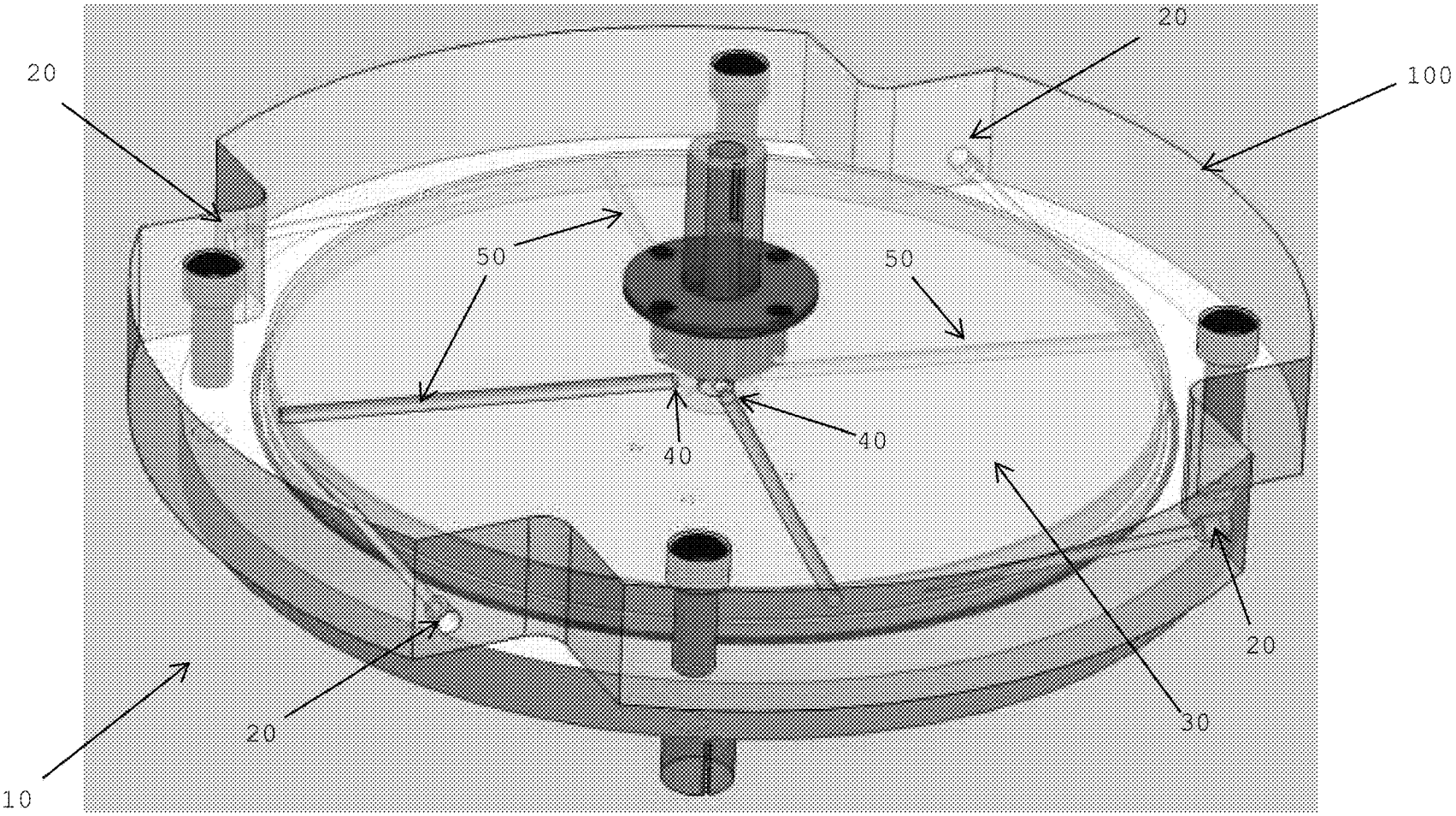
FIG. 2 is a partially transparent isometric view of a mechanism according to one aspect of the invention.

Referring to FIG. 2, a partially transparent isometric view of the mechanism is provided. As can be seen, the partially transparent view in FIG. 2 is provided to present the internal workings and components of the mechanism.

The mechanism 10 in FIG. 2 has four inlet ports 20 through which a pressurized gas can be provided to the mechanism. A rotatable rotor 30 is inside the mechanism. The rotor 30 has four exit ports 40 located at its center and four conduits 50 extending radially from the exit ports 40 to the outer perimeter of the rotor. The conduits 50 are hollow and provide a passageway for pressurized gas to travel from the outer perimeter of the rotor to the exit port. In this embodiment of the invention, the conduits are all straight and do not deviate from the exit port to the outer perimeter of the rotor.

Figure 3:
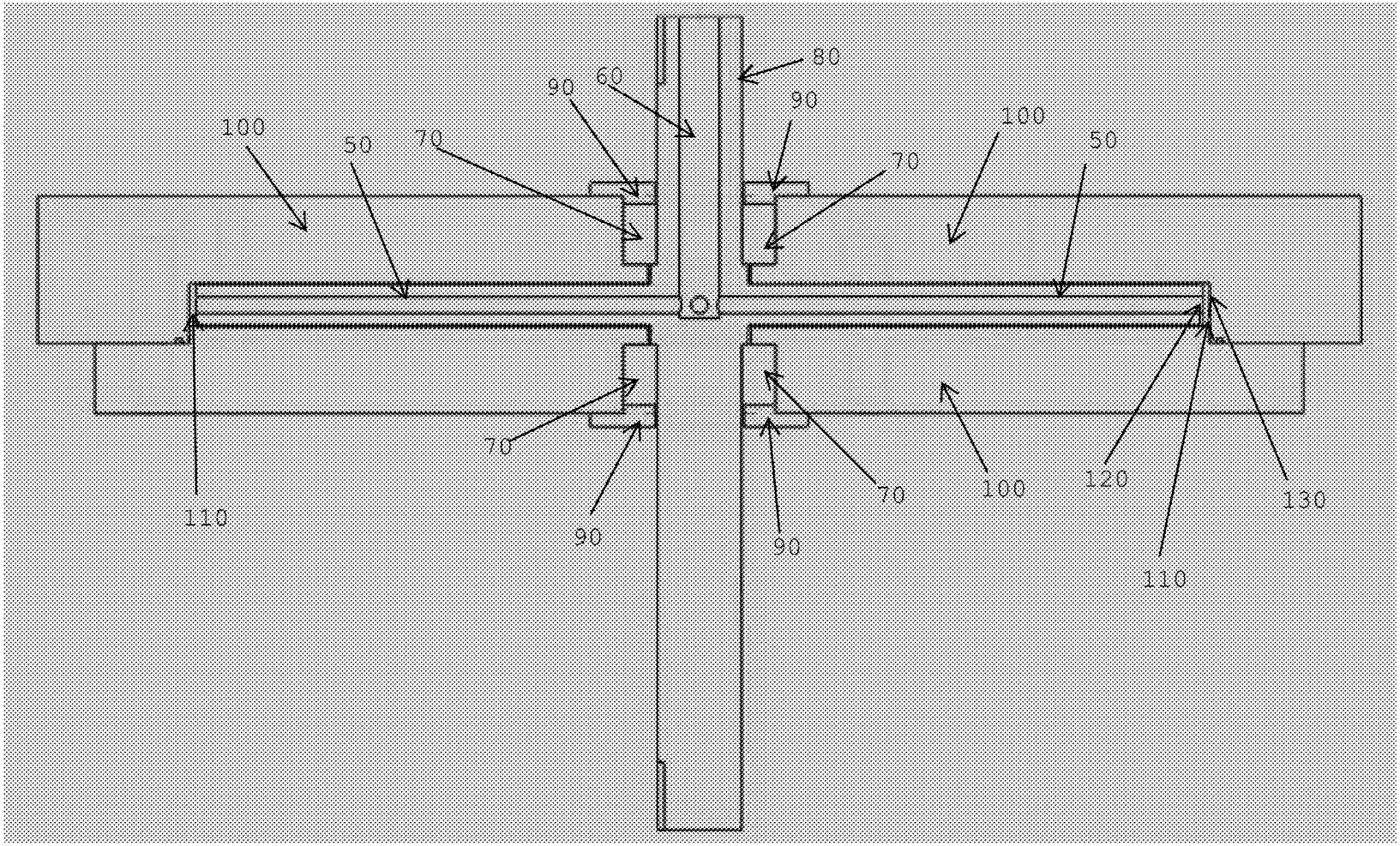
FIG. 3 is a cross-sectional view of the mechanism of FIG. 2.

Referring to FIG. 3, a side cut-away view of the mechanism in FIG. 2 is provided. The exit ports 40 at the center of the rotor 30 lead to a gas exit conduit 60 through which the pressurized gas exits the mechanism. To facilitate the rotation of the rotor 30, the rotor 30 is supported by bearings 70 which allow the rotor 30 to freely rotate. A driveshaft 80 is coupled to the rotor 30 such that rotation of the rotor 30 similarly rotates the driveshaft 80. As can be seen, the gas exit conduit 60 is inside the driveshaft 80. Seals 90 adjacent the bearings 70 and the driveshaft 80 ensure that an airtight seal is maintained for the mechanism. Similarly, an enclosure 100 provides an airtight environment for the mechanism. In this configuration, the driveshaft 80 is collinear with the rotor's axis of rotation.

It should be noted that, preferably, there should be minimal space between the rotor and the upper and lower portions of the enclosure. However, there should a gap 110 between the outer perimeter or periphery 120 of the rotor 30 and the inside wall 130 of the enclosure 100. The gap 110 is there to allow the pressurized gas to travel from the inlet ports to the various conduits.

Figure 4:
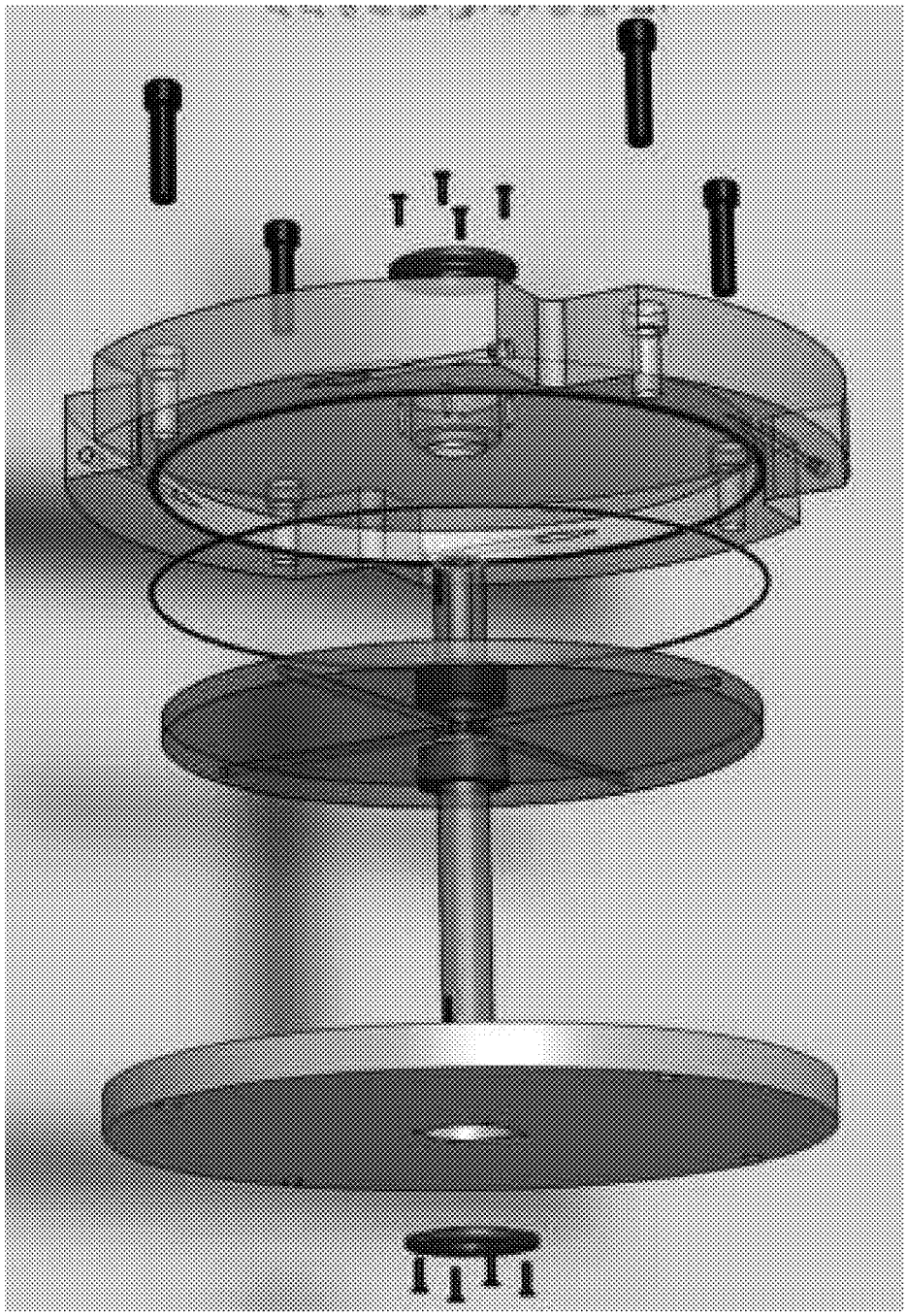
FIG. 4 is an exploded view of the mechanism illustrated in FIG. 2.

In operation, a pressurized gas is provided to the mechanism by way of the inlet ports. In FIGS. 2-4, the ports are oriented such that gas is injected in a direction tangential to the rotor periphery and in the direction of rotor rotation. This configuration is preferable as it provides optimal results. The pressurized gas enters the conduits and travels from the outer perimeter of the rotor to the exit port at the center of the rotor. In doing so, the pressurized gas causes the rotor to rotate about its center and thereby also causes the driveshaft to rotate. While travelling from the outer perimeter or periphery of the rotor to the exit port, the temperature of the pressurized gas drops, thereby providing a cooler gas at the exit port than at the outer perimeter of the rotor.

An exploded view of the mechanism in FIGS. 2-3 is illustrated in FIG. 4 to provide the reader with a more detailed view of the various parts of the mechanism.

It should be noted that the variant illustrated in FIGS. 2A-2B, 3A, and 4A offers a number of enhancements to the base device illustrated in FIGS. 2, 3, and 4.

Figure 2A:
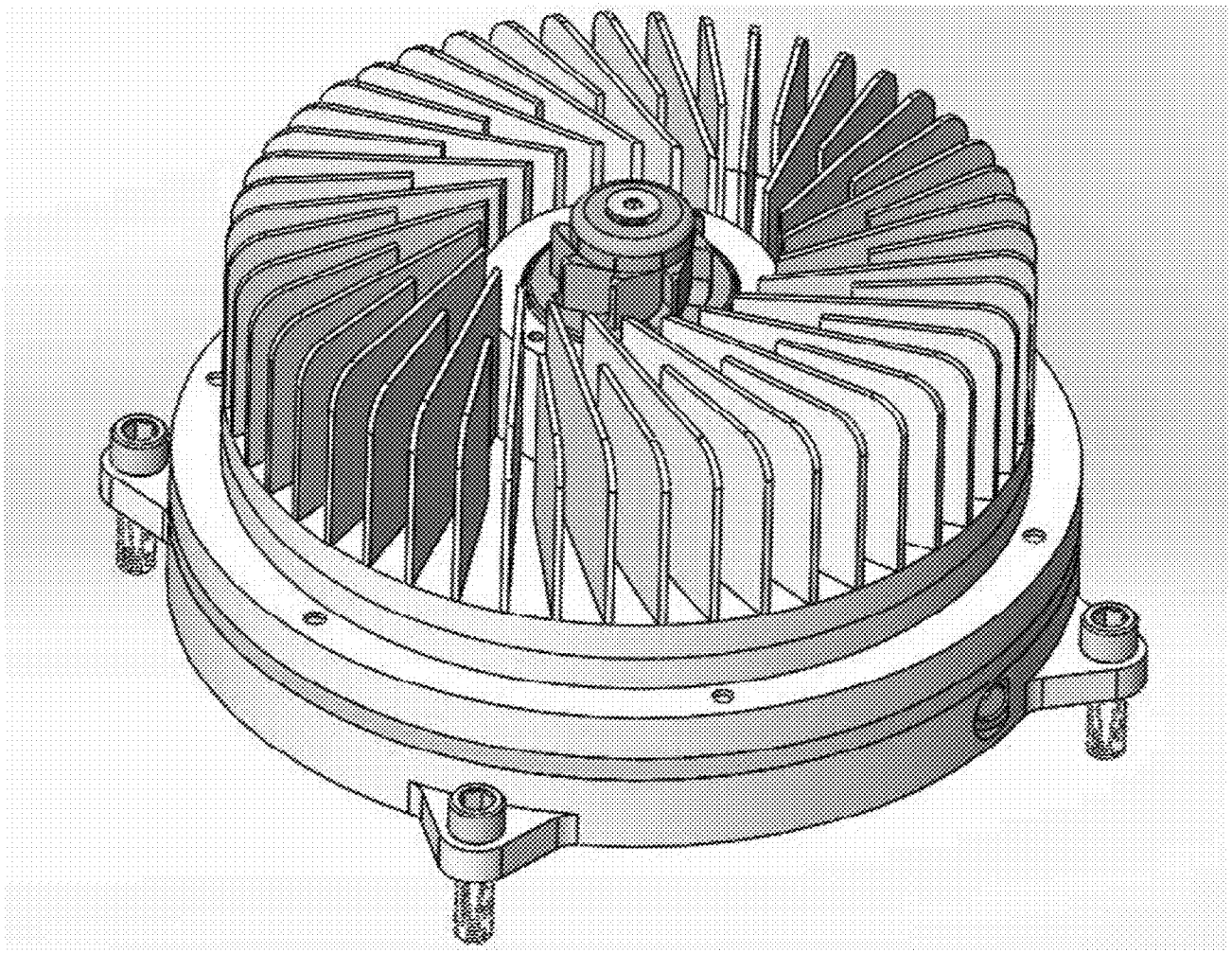
FIG. 2A is an isometric view of a variant of the mechanism illustrated in FIG. 2.

Referring to FIG. 2A, an isometric view of a variant of the mechanism in FIG. 2 is illustrated. As can be seen, this variant is equipped with a number of heat sink vanes atop the mechanism.

Figure 2B:
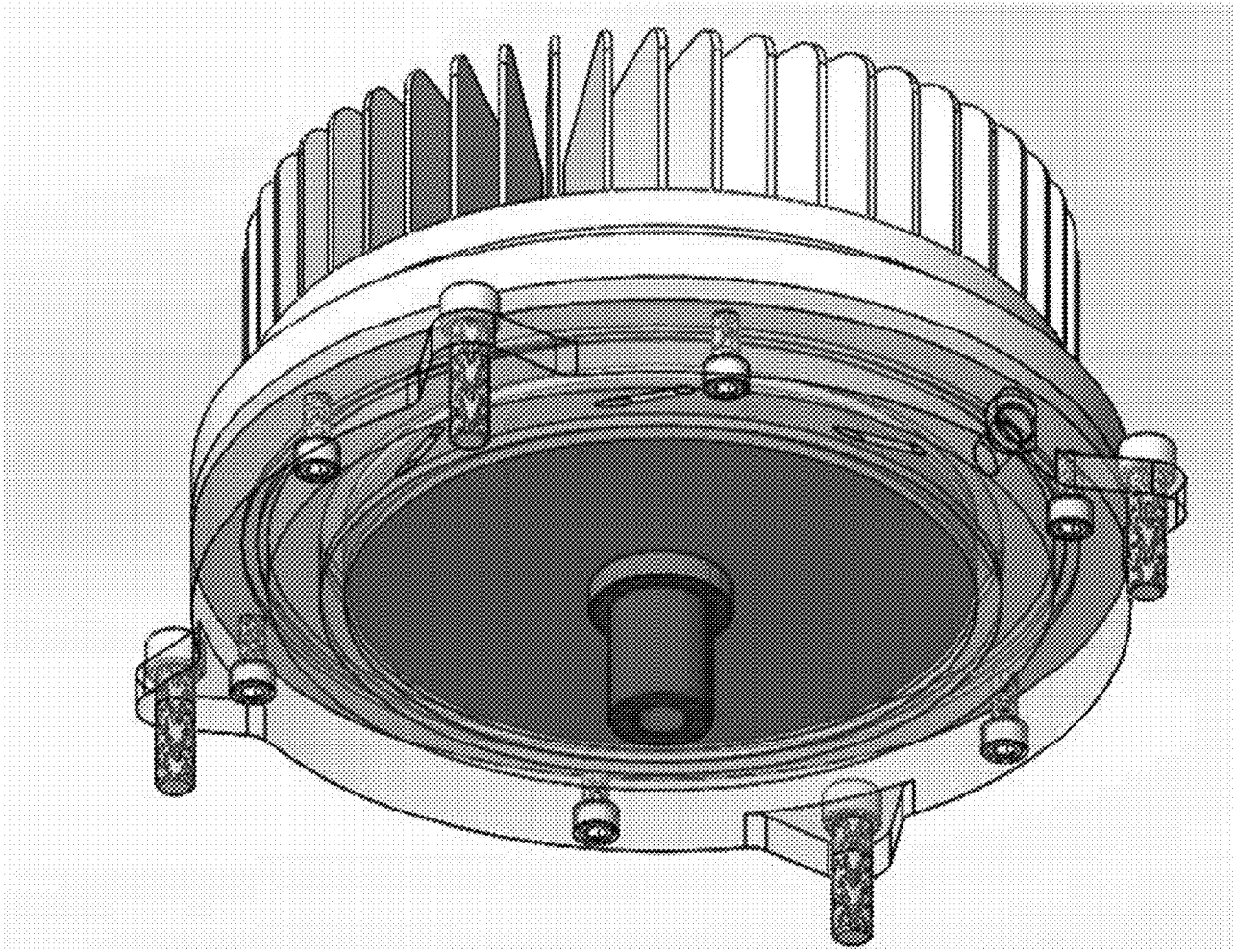
FIG. 2B is a partially transparent view of the underside of the variant illustrated in FIG. 2A.

Referring to FIG. 2B, a partially transparent bottom view of the mechanism in FIG. 2A is illustrated. From this view, a ring with angled holes (nozzle ring) can be seen that separates the inlet region from the periphery of the rotor. In addition, the entrance ports to the conduits can be seen on the rotor.

Figure 3A:
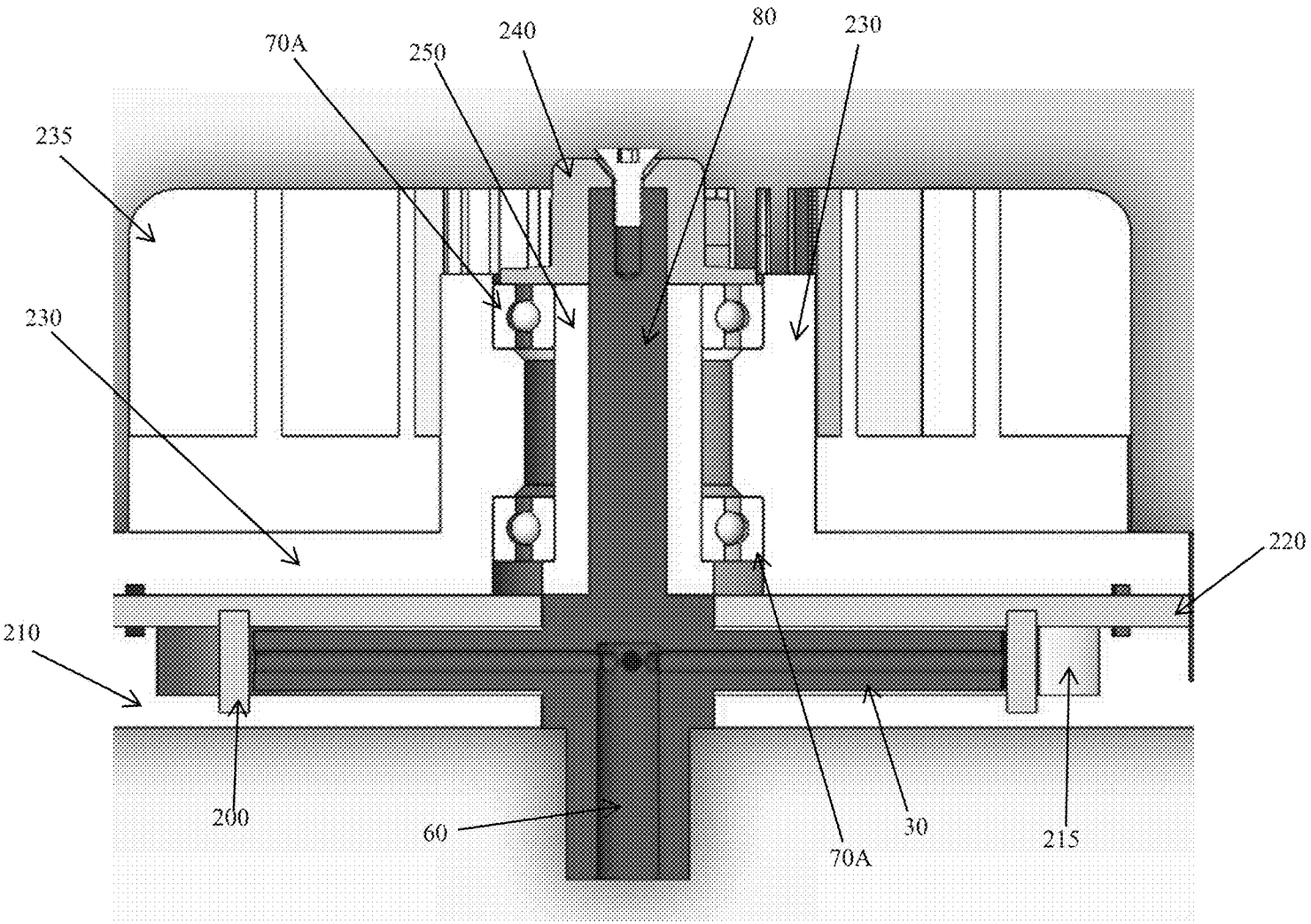
FIG. 3A is a cross-sectional view of the mechanism of FIG. 2A.

Referring to FIG. 3A, a side cut-away view of the variant illustrated in FIG. 2A is illustrated. As can be seen, this variant operates in much the same manner as the mechanism in FIGS. 2 and 3.

Figure 4A:
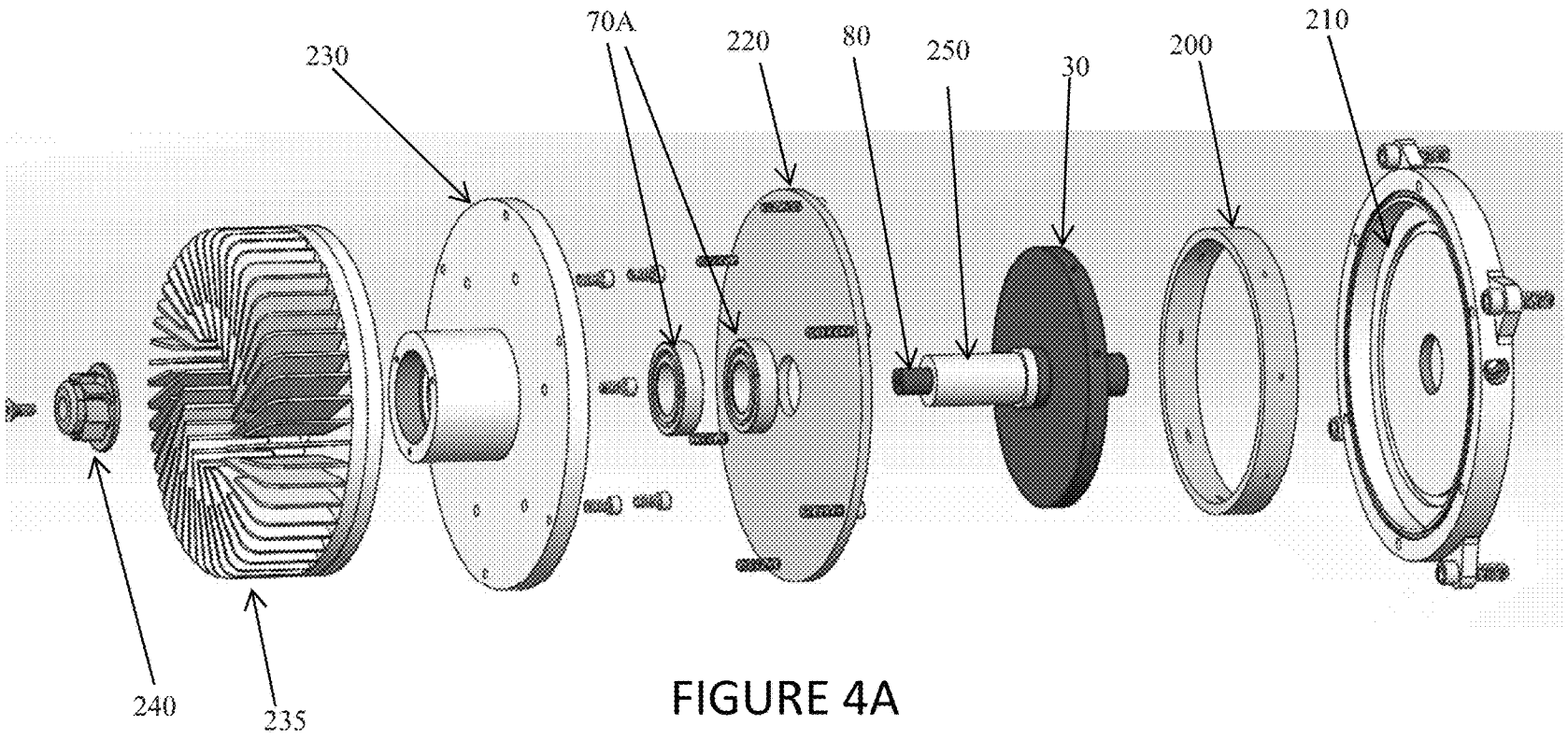
FIG. 4A is an exploded view of the mechanism illustrated in FIG. 2A.

An exploded view of the mechanism in FIGS. 2A-2B and 3A is provided in FIG. 4A.

Referring to FIGS. 3A and 4A, the variant has a rotor 30 similar to the embodiment illustrated in FIGS. 2 and 3. However, the bearings 70A in the variant are only located on one side of the rotor 30 instead of on both sides of the rotor 30 as in FIG. 3. The variant also has a nozzle ring 200 that is nested inside a lower housing 210. Between the nozzle ring 200 and the lower housing 210 is an inlet plenum 215. The inlet plenum 215 is, essentially, a gap or space between the inner portion of the lower housing 210 and the outer perimeter of the nozzle ring 200 to which compressed air is supplied to the mechanism through one or more inlets. Atop the rotor is a separation ring 220 and on top of the ring 220 is a shroud 230. A heat sink 235 sits on top of the shroud 230 and, on top of driveshaft 80, is a fan 240.

The rotor 30 in this variant also has a driveshaft 80 similar to the embodiment in FIGS. 2 and 3. However, in this variant, a rotor sleeve 250 is used to insulate the rotor from heat generated by other parts of the mechanism.

The variant in FIGS. 3A and 4A has a number of improvements over the embodiment illustrated in FIGS. 2, 3, and 4. Specifically, the variant thermally isolates the refrigeration section from the energy conversion section. The energy conversion section of the mechanism converts the rotational work of the rotor to heat and thereby achieves refrigeration (i.e. cooling of the compressed air). The refrigeration section of the mechanism allows for the cooling of the compressed air. The isolation between these two sections is accomplished by the thermal break section. The energy conversion section includes the bearings, the shroud, the heat sink, and the fan while the refrigeration section includes the inlet plenum, the nozzle ring, and the rotor. The thermal break section includes the rotor sleeve, the separation ring, the housing, and the nozzle ring.

To assist in the efficiency and steady-state operation of the mechanism in cooling the compressed air, a number of measures were implemented in this variant. One measure implemented was that of placing the bearings at one side of the rotor instead of at both sides of the rotor as in the embodiment illustrated in FIGS. 2, 3, and 4. These bearings support the rotor and enable stable, high-speed rotation of the rotor as well as provide resistance to rotation to thereby load the rotor. This resistance gives rise to the conversion of mechanical energy to thermal energy. Referring to FIG. 3A, the bearings 70A are all on one side of the rotor and are isolated from driveshaft 80 by rotor sleeve 250 to insulate the rotor from heat generated by the bearings. In this manner, energy removed as propulsion from the compressed gas and subsequently converted to heat is not re-introduced into the refrigerated airstream.

Another measure to assist in increasing the efficiency and steady-state operation of the mechanism is the introduction of shroud 230 and heat sink 235. The shroud 230 supports the bearings 70A. As well, the shroud 230 absorbs heat from the bearings and transfers this heat to the heat sink 235. The heat sink 235 absorbs heat from the shroud 230 and releases this heat to the surrounding environment. To further assist in releasing this heat, the fan 240 blows ambient air across the heat sink 235 to enhance convective heat transfer. The fan also ensures that the heat sink operates at a relatively low temperature to thereby facilitate high heat transfer from the bearings. The fan also absorbs energy from the rotor and thereby further loads the rotor to further facilitate conversion of mechanical energy to heat.

The thermal break section of the mechanism also contributes to the efficiency and steady-state operation of the mechanism by isolating the conversion section from the refrigeration section. The rotor sleeve 250 provides a thermal break between the inner case of the bearings 70A and the rotor. Heat is thereby transferred from bearings to the shroud instead of to the rotor. Heat from the bearings is thereby not transferred to the refrigerated air exiting by way of the gas exit shaft 60.

Also part of the thermal break section is the separation ring 220. In one implementation, this ring is constructed from plastic for its insulation properties. This ring thermally isolates (or provides a thermal break) the conversion section from the refrigeration section. This thermal isolation prevents compressed air from being preheated in the inlet plenum and also prevents the rotor from being warmed by radiation from the upper housing by way of the shroud. As well, the ring isolates the nozzle ring from the shroud and thereby prevents heat from the conversion section to preheat air in the lower housing.

It should be noted that while the above described variant uses specific methods and components for specific ends, other implementations are, of course possible. As an example, while the conversion section uses bearings, the fan, and the heat sink to load the mechanism, other methods of loading, including the use of high-speed generators or an electrical load, may also be used. Similarly, while the variant uses a plastic separation ring and a rotor sleeve, other methods and material which similarly isolate the conversion section from the refrigeration section may be used. As an example, the rotor itself may be constructed from plastic to lessen the need for the rotor sleeve 250.

Regarding the implementation of the mechanism illustrated in the Figures, the four conduits illustrated divide the rotor into four quadrants. Preferably, these quadrants are of equal size with each conduit being at 90 degrees from adjacent conduits for the purpose of mechanical balancing of the rotor.

It should be noted that while four straight conduits are shown in the drawings, other configurations are possible. As an example, a three conduit configuration is possible, with each conduit being at 120 degrees to its adjacent conduits. Similarly, more than four conduits may be used.

Again regarding the spacing of the conduits on the rotor, it should be noted that while a regular spacing between conduits is preferable, an uneven spacing between the conduits may also be used.

It should be noted that the rotor can be extended axially to provide space such that radial conduits can be provided in layers, thereby allowing for any number and configuration of conduits. Different configurations for such an arrangement are possible. As an example, differing layers of conduits and rotors may be stacked above one another with a common exit port at the center of the driveshaft for the varying rotors.

The conduits may be formed as a tunnel in the material of a solid rotor or the conduits may be a hollow tube embedded in the structure of the rotor. Similarly, the conduits need not be located within the rotor—placement of the conduits may be above, under, or inside the rotor as long as the conduits are coupled to the rotor such that pressurized gas travelling through the conduits will cause the rotor to rotate. The conduits may have any suitable shape but it has been found that straight conduits that directly radiate from the center of the rotor to the rotor's periphery provided the best results.

As well, while the figures illustrate straight conduits which radially radiate from the center of the rotor, straight conduits which are tangential to the central exit port are also possible. Such a configuration would still have each conduit providing a direct passage from the outer perimeter of the rotor to the exit port. However, for this configuration, the conduits would be directing the pressurized gas in a direction tangential to the exit port instead of in a direction that is radial to the exit port.

The pressurized gas may be provided to the periphery of the rotor in any suitable manner. Preferably, if the pressurized gas is to be injected into the mechanism, the gas is to be injected in a direction that is tangential to the rotor and at right angles to the rotor's axis of rotation. Differing angles at which the pressurized gas may be provided to the mechanism may be used as long as the gas is not injected in a direction with components that are opposite to the direction of rotation of the rotor. As well, it is preferred that the direction of the pressurized gas is not parallel to the axis of rotation of the rotor.

It should be noted that the radial distance between the rotor's axis of rotation and the exit port should be less than the radial distance between the rotor's axis of rotation and the inlet port. In the configuration illustrated in FIGS. 2, 3, and 4, the rotor's axis of rotation is at the center of the rotor such that the distance between the rotor's axis of rotation and the exit port is at a minimum. However, other configurations where the exit port is not at the center of the rotor are possible. It should further be noted that, while multiple exit ports are also possible, a single exit port at the center of the rotor is preferable as this has been shown to provide the most efficient cooling and energy extraction.

For configurations that have multiple exit ports, each of the various conduits connects one or more of the inlet ports to an exit port. It should be clear that the various inlet ports and their associated exit ports need not be on the same plane. It should also be clear that each inlet port is associated with an exit port with a conduit directly connecting an inlet port (or multiple inlet ports) with an exit port.

It should be noted that in the configurations illustrated in the Figures, the inlet port is located at the periphery of the rotor. However, other configurations where the inlet port is not at the periphery of the rotor are possible, as long as the radial distance from the center of rotation to the inlet port is larger than the radial distance from the center of rotation to the associated exit port.

It should also be noted that not all inlet ports need be at the same radial location. Any configuration is possible provided that the radial distance from the center of rotation to the inlet port is larger than the radial distance from the center of rotation to the associated exit port.

While the Figures and the discussion above describe multiple conduits, a configuration using a single inlet port and a single conduit connecting the inlet port to a single exit port is also possible.

Regarding the pressurized gas, this may be any suitable gas such as compressed air.

Regarding the use of the mechanism, the mechanism may be used in any device, motor, engine, or system that involves a rotating rotor or the cooling of a pressurized gas. As noted above, the temperature of the pressurized gas at the periphery of the rotor is higher than the gas exiting at the exit port. Accordingly, the mechanism may be used in applications that require the cooling or the lowering of the temperature of a pressurized gas. Similarly, the rotation of the rotor may be used to turn a shaft that can be used to do work. The mechanism may therefore be used as part of a pneumatic engine, turbine, or motor.

In one configuration, the rotation of the rotor may be used to pressurize gas to be used in the mechanism. As an example, ambient gas may be pressurized using the rotation of the rotor. Once pressurized, the pressurized gas may then be further pressurized by external means and then introduced into the system.

Once the pressurized gas has been introduced into the system, a pre-rotation may be needed to start the system. This may take the form of manually rotating the rotor. Once the rotor starts rotating, the pressurized gas in the system can continue the rotor's rotation.

Experimental results from a prototype of the invention shown in FIGS. 2A, 2B, 3A and 4A show significant cooling of pressurised gas as the gas passes from the inlet port to the exit port. These results and the parameters used are as follows:

| P_in (Input pressure in psig) | P_exit (Exit pressure in psig) | T_in (Gas temperature at input in degrees C.) | T_exit (Gas temperature at exit in degrees C.) | Flowrate (slpm) | Speed (rpm) |
|---|---|---|---|---|---|
| 30.1 | 0 | 22.8 | 1.8 | 571 | 27,844 |
| 37.5 | 0 | 22.8 | 0.5 | 601 | 28,800 |
| 43.2 | 0 | 22.9 | −0.4 | 621 | 29,440 |

It should be noted that the mechanism explained above can operate at much lower compressed air flowrates while maintaining high efficiency. Similarly, the mechanism uses a high solidity rotor which maximizes the difference between the radial inlet and the radial outlet to thereby achieve maximum refrigeration. When compared to a Ranque-Hilsch vortex tube, the mechanism accomplishes equivalent refrigeration with much lower compressed air source pressures. As well, equivalent refrigeration is achieved without the need for a hot exit stream and such equivalent refrigeration is achieved with approximately half the volume of compressed air.

To better understand the principles behind the invention, the following references are provided. These references are hereby incorporated by reference.

G. J. Ranque, "Experiments on expansion in a vortex with simultaneous exhaust of hot and cold air", J. Phys. Radium, vol. 4, p. 112S, 1933.

Y. Xue, M. Arjomandi and R. Kelso, "A critical review of temperature separation in a vortex tube", Exper. Therm. Fluid Sci., vol. 34, p. 1367, 2010.

E. A. Baskharone, "Principles of Turbomachinery in air-breathing engines", Cambridge University Press, Jul. 31, 2006.

M. G. Rose, "From Rothalpy to Losses", Lecture Notes, Swiss Federal Institute of Technology LSM Zurich 2002.

R. Resnick and D. Halliday, "Physics I", p. 307, Wiley, 1966.

R. T. Balmer, "Pressure-driven Ranque-Hilsch Temperature Separation in Liquids", J. Fluid Engn., vol. 110, p. 161, 1988.

R. A. Van den Braembussche. Micro Gas Turbines—A Short Survey of Design Problems", NATO, RTO-EN-AVT-131, (2005).

M. O. Hamdan, A. Alawar, E. Elnajjar and W. Siddique, Feasibility of Vortex Tube Air-Conditioning System", Proc. ASME, AJTEC2011, (2011).

A person understanding this invention may now conceive of alternative structures and embodiments or variations of the above all of which are intended to fall within the scope of the invention as defined in the claims that follow.

We claim:

1. A mechanism comprising:

a rotatable rotor having an axis of rotation;

an exit port;

an inlet port, said inlet port being for receiving pressurized gas;

a hollow conduit, said hollow conduit directly connecting said inlet port to said exit port;

a refrigeration section for cooling said pressurized gas, said refrigeration section including said rotor;

a conversion section for converting rotational energy of said rotor to heat, thereby achieving a cooling of said pressurized gas, said conversion section including a heat sink, at least one bearing, and a shroud, wherein said conversion section is for absorbing said heat; and a thermal break section, said thermal break section comprising a separation ring that separates said rotor from said shroud and from said heat sink to provide thermal isolation between said refrigeration section and said conversion section;

wherein a radial distance between said axis of rotation and said exit port is less than a radial distance between said axis of rotation and said inlet port;

pressurized gas received at said inlet port passes from said inlet port to said exit port through said conduit to thereby cause said rotor to rotate about said axis of rotation;

after passing through said conduit, said pressurized gas at said exit port is colder than said pressurized gas at said inlet port.

2. The mechanism according to claim 1, wherein said thermal break section further comprises a rotor sleeve and said conversion section is further thermally isolated from said refrigeration section by said rotor sleeve.

3. The mechanism according to claim 1, wherein said at least one bearing is placed on only one side of said rotor to thermally isolate said conversion section from said refrigeration section.

4. The mechanism according to claim 1, wherein said mechanism lowers a temperature of said pressurized gas and converts energy extracted from said pressurized gas into rotational work.

5. The mechanism according to claim 1, wherein said pressurized gas is injected at said inlet port, said pressurized gas being injected at a direction tangential to said rotor and at right angles to said axis of rotation.

6. The mechanism according to claim 1, further comprising at least one other exit port.

7. The mechanism according to claim 6, further comprising at least one further inlet port and at least one further conduit, said at least one further conduit connecting said at least one further inlet port to either said at least one other exit port or said exit port.

8. The mechanism according to claim 6, further comprising at least one further inlet port and at least one further conduit, said at least one further conduit connecting said at least one further inlet port to said exit port.

9. The mechanism according to claim 1, wherein a rotation of said rotor is used to partially pressurize a gas to result in said pressurized gas.

10. The mechanism according to claim 1, wherein a distance between said axis of rotation and said exit port is at a minimum.

11. The mechanism according to claim 1, wherein a flow rate for said pressurized gas at said exit port is between 9 and 24 scfm (255 and 708 slpm).

12. The mechanism according to claim 1, wherein said exit port is at a center of said rotor.

13. The mechanism according to claim 1, wherein said conversion section further includes a fan adjacent to said heat sink.

14. The mechanism according to claim 13, wherein said fan is powered by said rotational energy.

15. The mechanism according to claim 1, wherein said refrigeration section includes at least one of: an inlet plenum and a nozzle ring.

16. The mechanism according to claim 1, wherein said heat sink is adjacent to said shroud on an opposite side from said separation ring.

* * * * *